US008375918B2

(12) United States Patent
Nagao

(10) Patent No.: US 8,375,918 B2
(45) Date of Patent: Feb. 19, 2013

(54) LUBRICANT SUPPLY DEVICE FOR AUXILIARY MACHINE OF ENGINE

(75) Inventor: Masafumi Nagao, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 214 days.

(21) Appl. No.: 12/838,390

(22) Filed: Jul. 16, 2010

(65) Prior Publication Data

US 2011/0030649 A1 Feb. 10, 2011

(30) Foreign Application Priority Data

Aug. 7, 2009 (JP) ..... 2009-184742

(51) Int. Cl.
*F01M 11/02* (2006.01)

(52) U.S. Cl. ..... 123/196 R; 123/198 C; 123/495; 123/508; 123/195 C; 123/195 A

(58) Field of Classification Search ..... 123/196 R, 123/198 C, 195 A, 195 C, 495, 508, 509
See application file for complete search history.

(56) References Cited

U.S. PATENT DOCUMENTS 4,759,556 A * 7/1988 Udagawa ..... 277/595
5,022,664 A * 6/1991 Kitada et al. ..... 277/591
5,544,901 A * 8/1996 Kubouchi et al. ..... 277/591
5,782,161 A * 7/1998 Okubo et al. ..... 92/71
6,079,382 A * 6/2000 Schafer et al. ..... 123/90.17
7,347,176 B1 * 3/2008 Estacio ..... 123/196 R
2002/0170521 A1 * 11/2002 Hilgert ..... 123/193.5
2005/0279318 A1 * 12/2005 Nagel et al. ..... 123/196 R
2009/0151661 A1 * 6/2009 Ahn ..... 123/41.82 R

FOREIGN PATENT DOCUMENTS

JP 2003-184688 7/2003
JP 2004-270557 9/2004

* cited by examiner

*Primary Examiner* — Noah Kamen
*Assistant Examiner* — Grant Moubry
(74) *Attorney, Agent, or Firm* — Alleman Hall McCoy Russell & Tuttle LLP

(57) ABSTRACT

An example lubricant supply device for an auxiliary machine of an engine includes a cam formed at one end of a cam shaft rotatably supported by a cylinder head. The lubricant supply device further includes a housing, for storing the auxiliary machine, attached to an attaching surface formed at an end of the cylinder head. The housing may hold a driven member driven by the cam. The lubricant supply device may further include a lubricant hole formed on the attaching surface through which lubricant is supplied from a lubricant passage formed in the cylinder head to the cam storage space. The lubricant supply device may further include a metal gasket positioned between the attaching surface and the housing to seal the cam storage space and outside. The metal gasket has a hole for communicating with the lubricant hole and a slit communicating between the hole and the cam storage space.

8 Claims, 10 Drawing Sheets

LUBRICANT SUPPLY DEVICE FOR AUXILIARY MACHINE OF ENGINE

FIELD OF THE INVENTION

This invention relates to a lubricant supply device for an auxiliary machine of an engine.

BACKGROUND OF THE INVENTION

In some engines, one end of a cam shaft is extended outside of a cylinder head of the engine, and a cam formed at the extension (of the cam shaft) drives various auxiliary machines. For example, Japanese Unexamined Patent Application Publication No. 2003-184688 and Japanese Unexamined Patent Application Publication No. 2004-270557 disclose a fuel pump as the auxiliary machine driven by the cam. Naturally, the auxiliary machine has a driven member driven by the cam, and the driven member might commonly be a plunger in the case where the auxiliary machine is the fuel pump.

In the case where the cam formed at the extension of the cam shaft drives the auxiliary machine, a housing for storing the auxiliary machine would be attached to the attaching surface formed at one end of the cylinder head. Therefore, the housing holds the driven member driven by the cam, and is attached to the attaching surface so as to cover the cam.

As described above, a cam storage space for storing the cam is formed in the housing attached to the attaching surface formed on the cylinder head. Lubricant (i.e. lubricating oil) needs to be supplied to the cam storage space from a lubricant passage formed in the cylinder head. Additionally, a metal gasket is positioned between the attaching surface of the cylinder head and the housing of the auxiliary machine.

It is required to supply the lubricant to the cam storage space stably, although a small amount of supplied lubricant may be enough. Therefore, it is supposed that a hole communicating between the lubricant passage formed in the cylinder head and the cam storage space could be made, for example, by drilling a small hole with a small drill bit, to produce a hole with a small cross section. However it might require some effort to make the hole for communicating between the cam storage space and the lubricant passage formed in the cylinder head. Further, the drill bit might be easily broken because the diameter of the drill bit would be small.

This invention is made so as to address the above problem. Therefore, the purpose of the invention is to provide a lubricant supply device for an auxiliary machine of an engine, wherein a hole for communicating between the cam storage space in the housing and the lubricant passage in the cylinder head can be made easily by effectively using a metal gasket for attaching the housing to the cylinder head.

SUMMARY

To achieve the above purpose, in accordance with an aspect of the invention, a lubricant supply device for an auxiliary machine of an engine, comprises a cam formed at one end of a cam shaft rotatably supported by a cylinder head, wherein the cam extends outside of the cylinder head; a housing for storing the auxiliary machine, attached to an attaching surface formed at an end of the cylinder head, wherein the housing holds a driven member driven by the cam and has a cam storage space for storing the cam; a lubricant hole formed on the attaching surface, through which lubricant is supplied from a lubricant passage formed in the cylinder head to the cam storage space; and a metal gasket positioned between the attaching surface and the housing, wherein the metal gasket seals the cam storage space and outside, wherein the metal gasket has a hole for communicating with the lubricant hole and a slit communicating between the hole and the cam storage space.

According to the above configuration, the lubricant in the lubricant passage in the cylinder head would be supplied from the lubricant hole formed on the attaching surface through the hole and the slit respectively formed in the metal gasket into the cam storage space. By adjusting the width of the slit, a small amount of the lubricant can be stably and easily supplied into the cam storage space. Further, the slit can be easily made in the metal gasket, for example during the manufacturing process of being press-molded.

In the preferable lubricant supply device for the auxiliary machine of the engine according to the invention, the metal gasket might have a circular sealing bead which surrounds the hole and a pair of linear sealing beads which are connected to the circular sealing bead and which respectively extend along both sides of the slit. According to the above configuration, the circular sealing bead and the linear sealing beads can securely seal the cam storage space and the outside.

Preferably, the slit might be formed inside of the circular sealing bead, and a part of the circular sealing bead might be provided close to the slit and outside of the slit so as to also serve as one of the linear sealing beads. According to the above configuration, as a part of the circular sealing bead can also serve as one of the linear sealing beads, it might be preferable to simplify the configuration of the metal gasket as much as possible.

Preferably, the auxiliary machine might be a high-pressure fuel pump which has a plunger as the driven member and which generates high-pressure fuel to be supplied to a fuel injector of the engine, and a lubricant return hole might be formed on the attaching surface to be facing and open into the cam storage space, wherein the lubricant return hole might return surplus lubricant gathered in the cam storage space into the cylinder head. According to the above configuration, the surplus lubricant gathered in the cam storage space can be returned securely through the lubricant return hole.

Preferably, a connection point between the slit and the cam storage space might be positioned approximately as high as or higher than the lubricant return hole. According to the above configuration, during an engine stop (e.g., when the cam shaft stops rotating), an amount of lubricant in the cam storage space can be prevented from becoming extremely low because the lubricant in the cam storage space may not flow backward through the slit.

According to the invention, by using the metal gasket effectively, a small amount of the lubricant can be stably supplied from the cylinder head into the cam storage space.

DETAILED DESCRIPTION OF THE EMBODIMENTS

Figure 1:
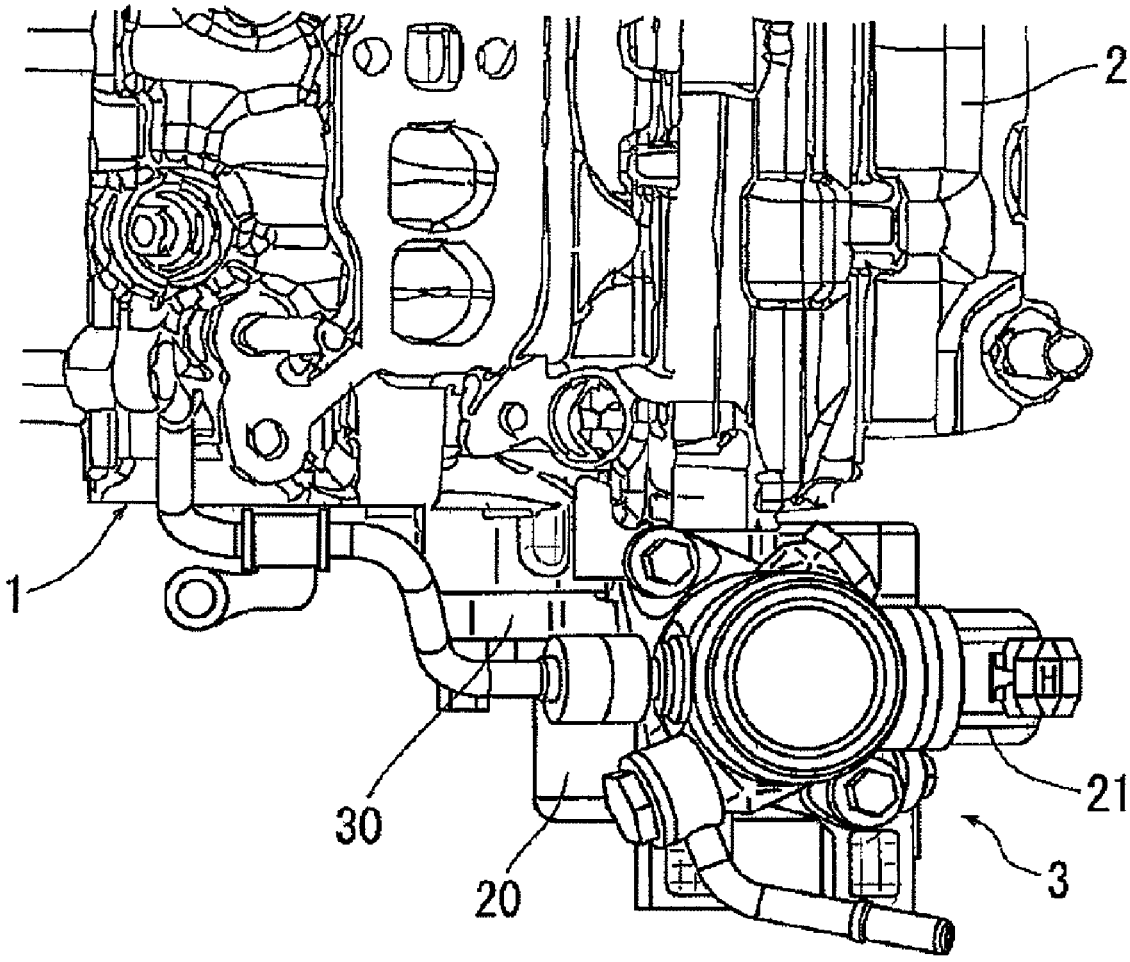
FIG. 1 is a view of an auxiliary machine portion viewed from an intake system side of an engine.
Figure 2:
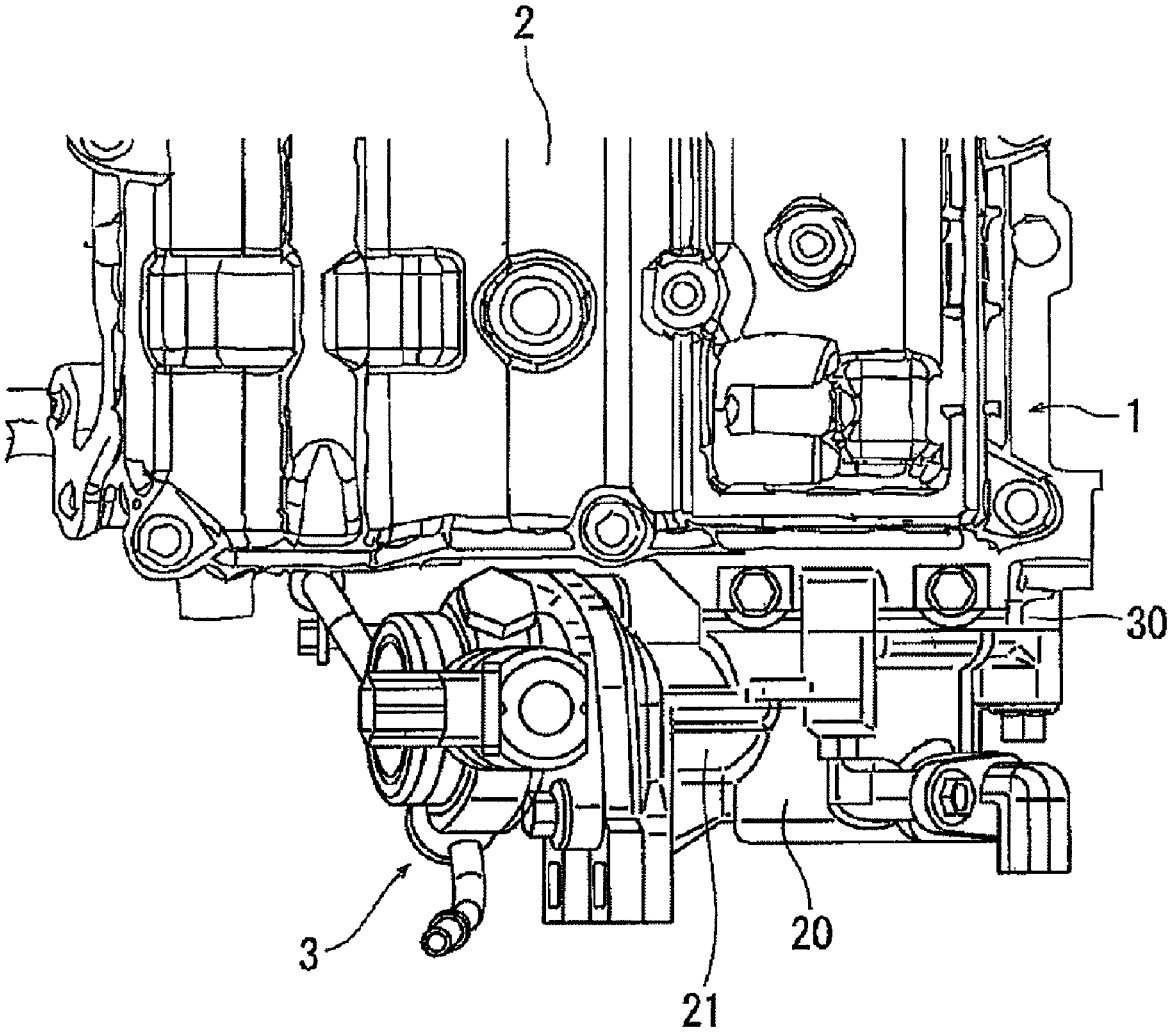
FIG. 2 is a view of the auxiliary machine portion viewed from above of the engine.
Figure 3:
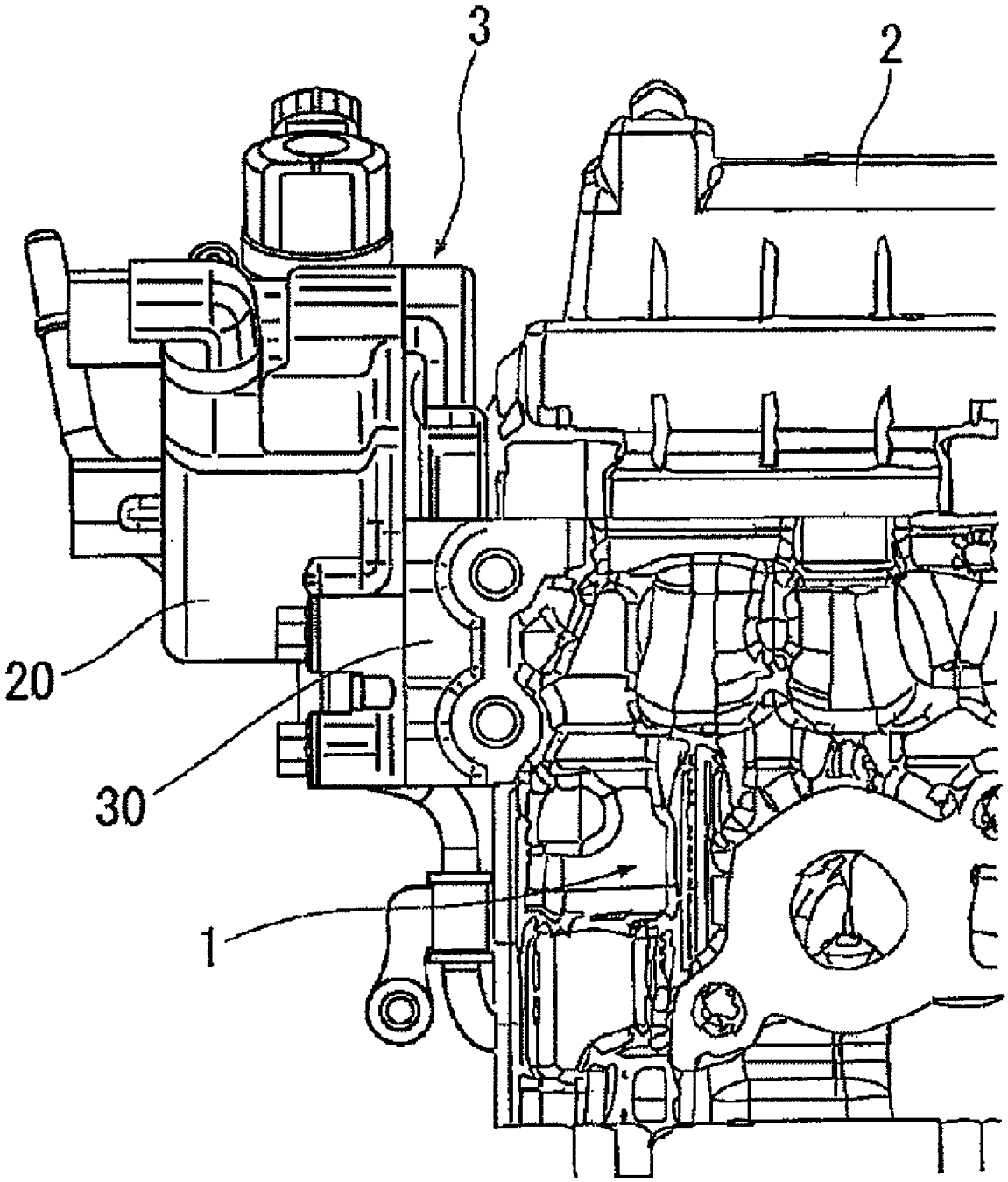
FIG. 3 is a view of the auxiliary machine portion viewed from an exhaust system side of the engine.
Figure 4:
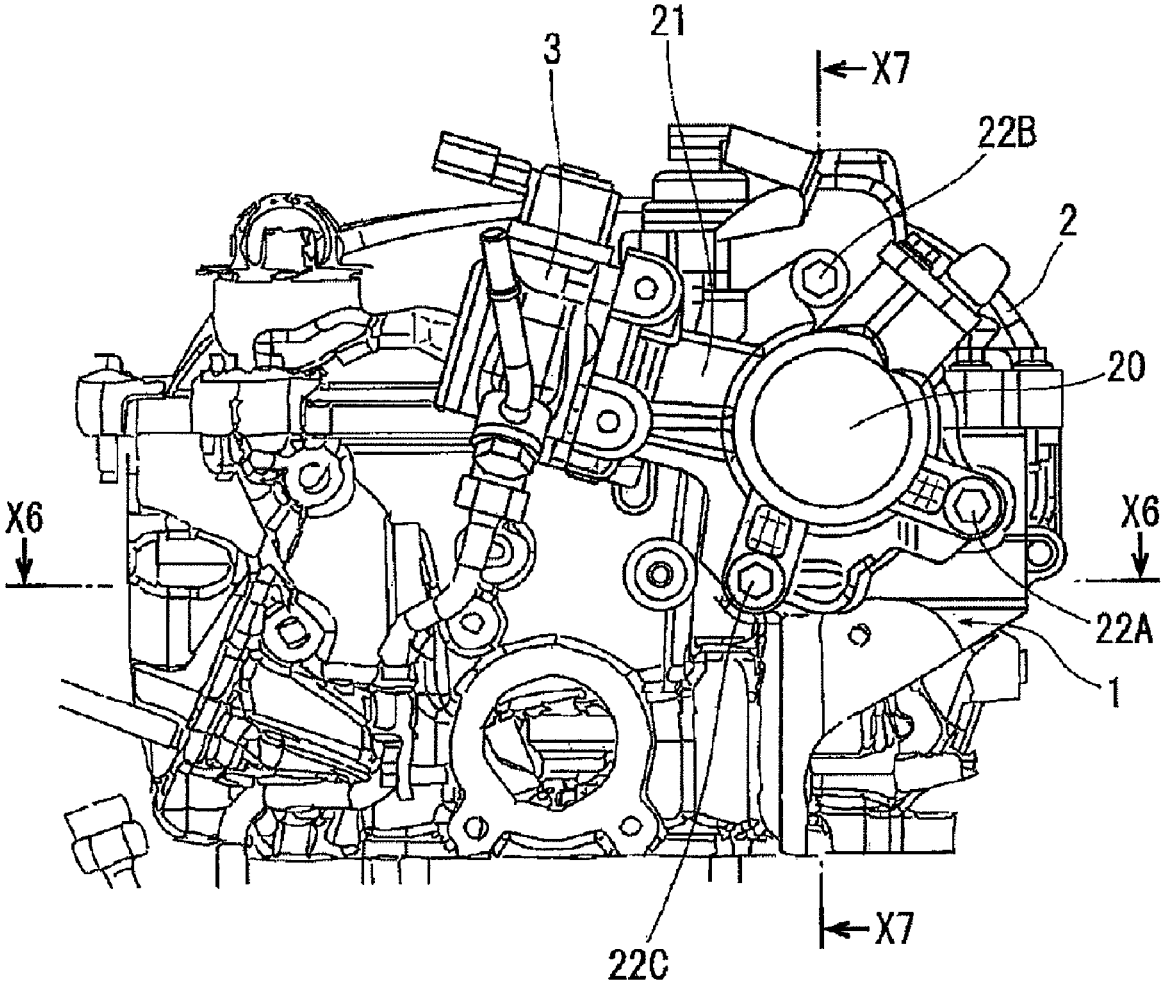
FIG. 4 is a view of the auxiliary machine portion viewed from one end side of a cam shaft.
Figure 5:
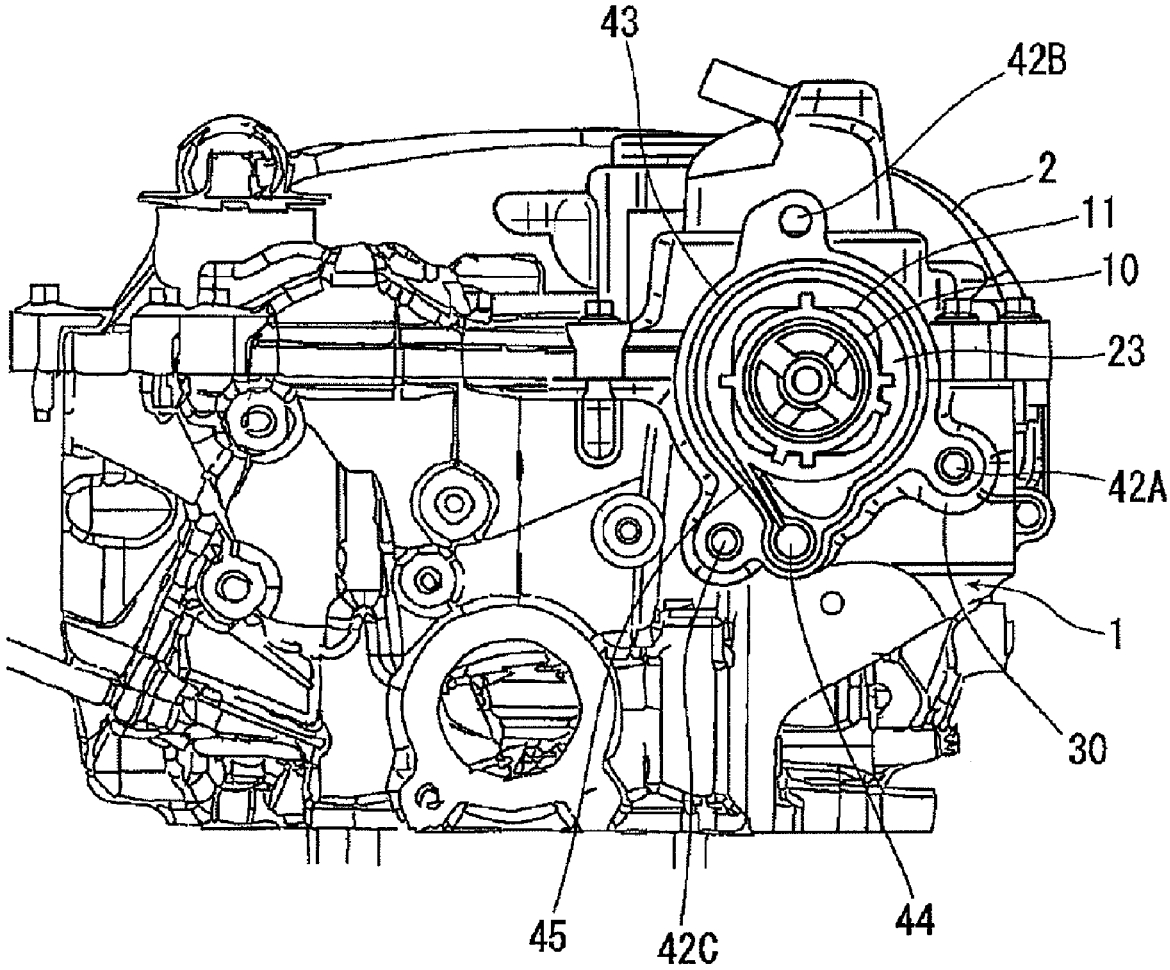
FIG. 5 is a view showing a state in which an auxiliary machine housing member is removed from the state of FIG. 4.
Figure 6:
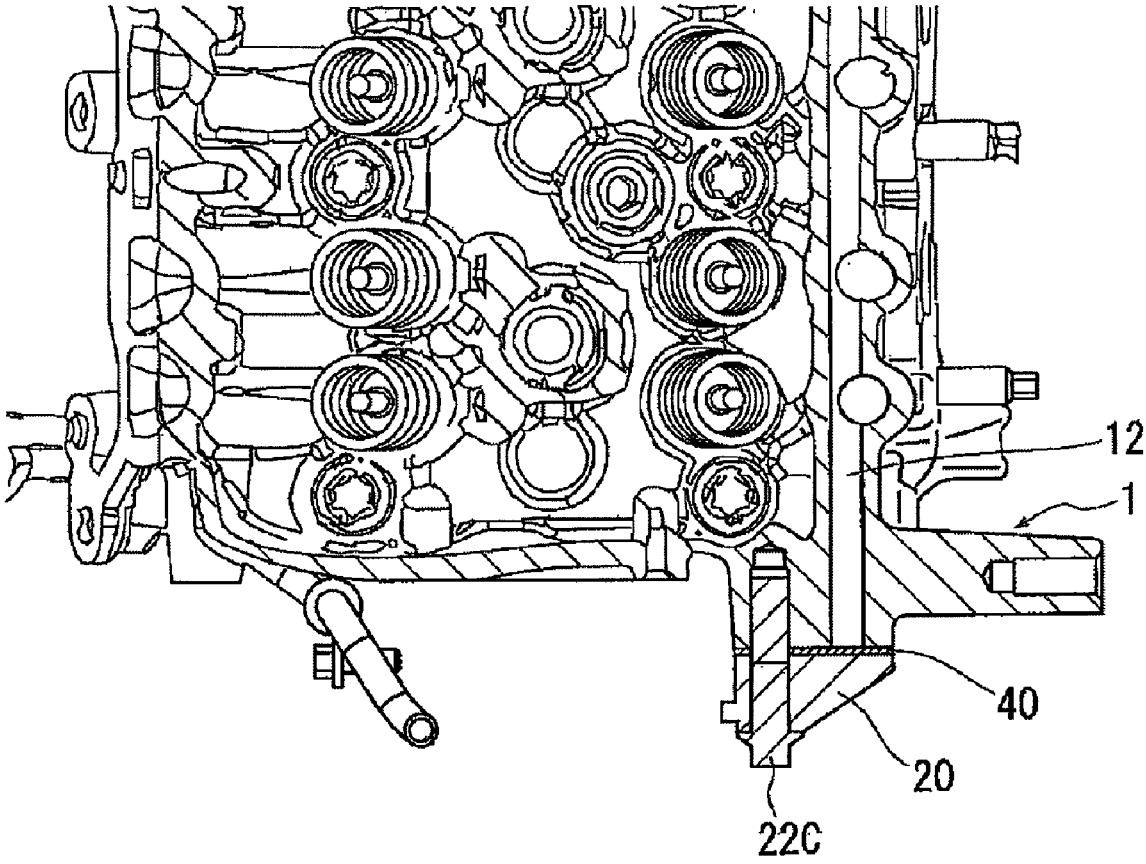
FIG. 6 is a cross-sectional view taken along a line X6-X6 of FIG. 4.

In FIGS. 1 to 5, reference numeral 1 denotes a cylinder head, numeral 2 denotes a cylinder head cover, numeral 3 denotes a fuel pump (high-pressure fuel pump for a fuel injection valve) attached to the cylinder head 1 at one end side in the engine cylinder arrangement direction (rear end side of the engine).

Figure 7:
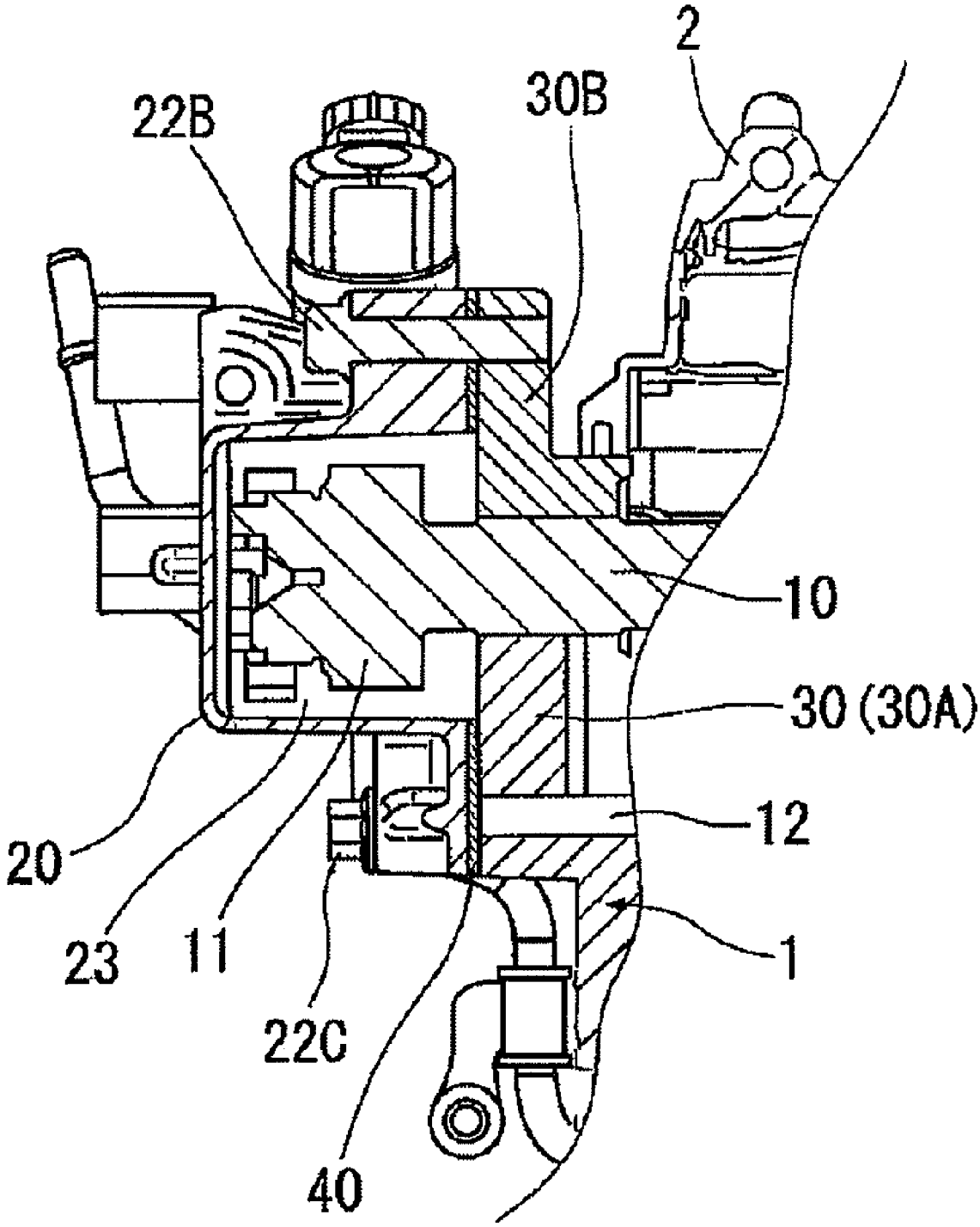
FIG. 7 is a cross-sectional view taken along a line X7-X7 of FIG. 4.

As shown in FIG. 7, a cam shaft 10 is rotatably held by the cylinder head 1. The cam shaft 10 extends to the outside from the one end side of the cylinder head 1, and a cam part 11 is formed in this extended part. The fuel pump 3 as an auxiliary machine is driven by the cam part 11.

The fuel pump 3 has an auxiliary machine housing member 20. The auxiliary machine housing member 20 has a plunger as a driven part which is driven by the cam part 11. Although illustration of the plunger itself is omitted in these figures, a holding part that holds the plunger is shown by numeral 21.

Figure 8:
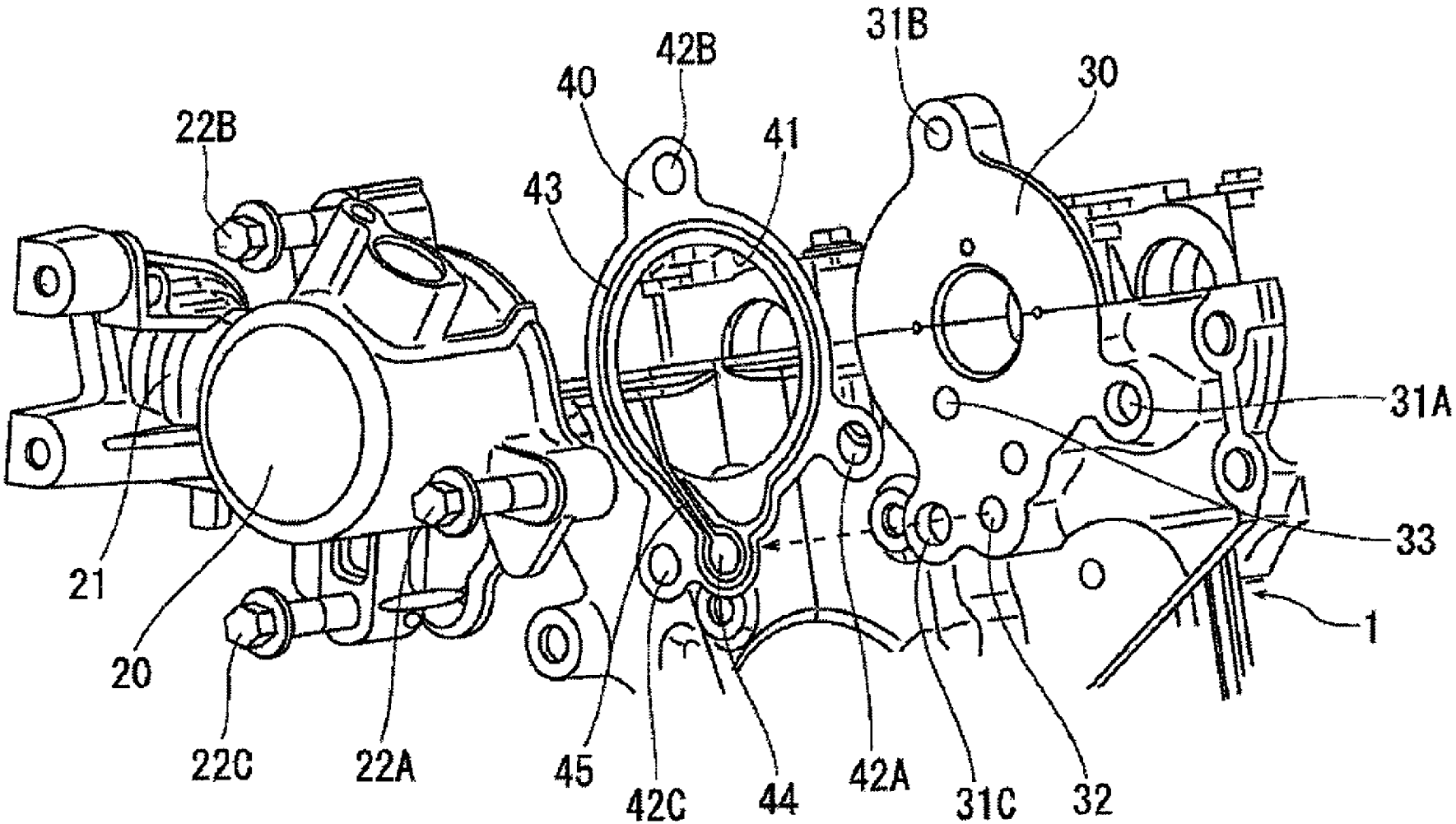
FIG. 8 is an exploded perspective view of an attaching part of the auxiliary machine part.

In FIGS. 7 and 8, an attaching part 30 that constitutes an attaching surface where the auxiliary machine housing member 20 is attached is formed on the one end side of the cylinder head 1. The attaching part 30 is vertically divided into two parts: a lower attaching part 30A integrally formed with the cylinder head 1, and an upper attaching part 30B (cap member) fixed to the cylinder head 1 by covering the cam shaft 10 from above. The upper attaching part 30B is attached to the cylinder head 1. Attachment holes 31A, 31B, and 31C for attaching the auxiliary machine housing member 20 are formed in the attaching part 30 formed on the cylinder head 1 side (refer to FIG. 8).

The auxiliary machine housing member 20 has a cup shaped part which opens toward the attaching part 30. The housing member 20 is fixed by threadedly engaging attachment bolts 22A, 22B, and 22C with the attachment holes 31A-31C of the attaching part 30 in a state in which an opening edge part of the cup shaped part is seated on the attaching part 30. In this fixed state, the plunger as the driven part held by the auxiliary machine housing member 20 contacts the cam part 11. The plunger reciprocates according to rotation of the cam shaft 10 to pressurize fuel.

The cam part 11 is covered entirely with the auxiliary machine housing member 20. That is, inside of the auxiliary machine housing member 20 around the cam part 11 forms a cam part storage space 23 (refer to FIG. 7). The cam part storage space 23 needs to be sealed from the exterior, and, for this reason, a metal gasket 40 intervenes between the auxiliary machine housing member 20 and the attaching part 30 (refer to FIGS. 7 and 8).

Figure 9:
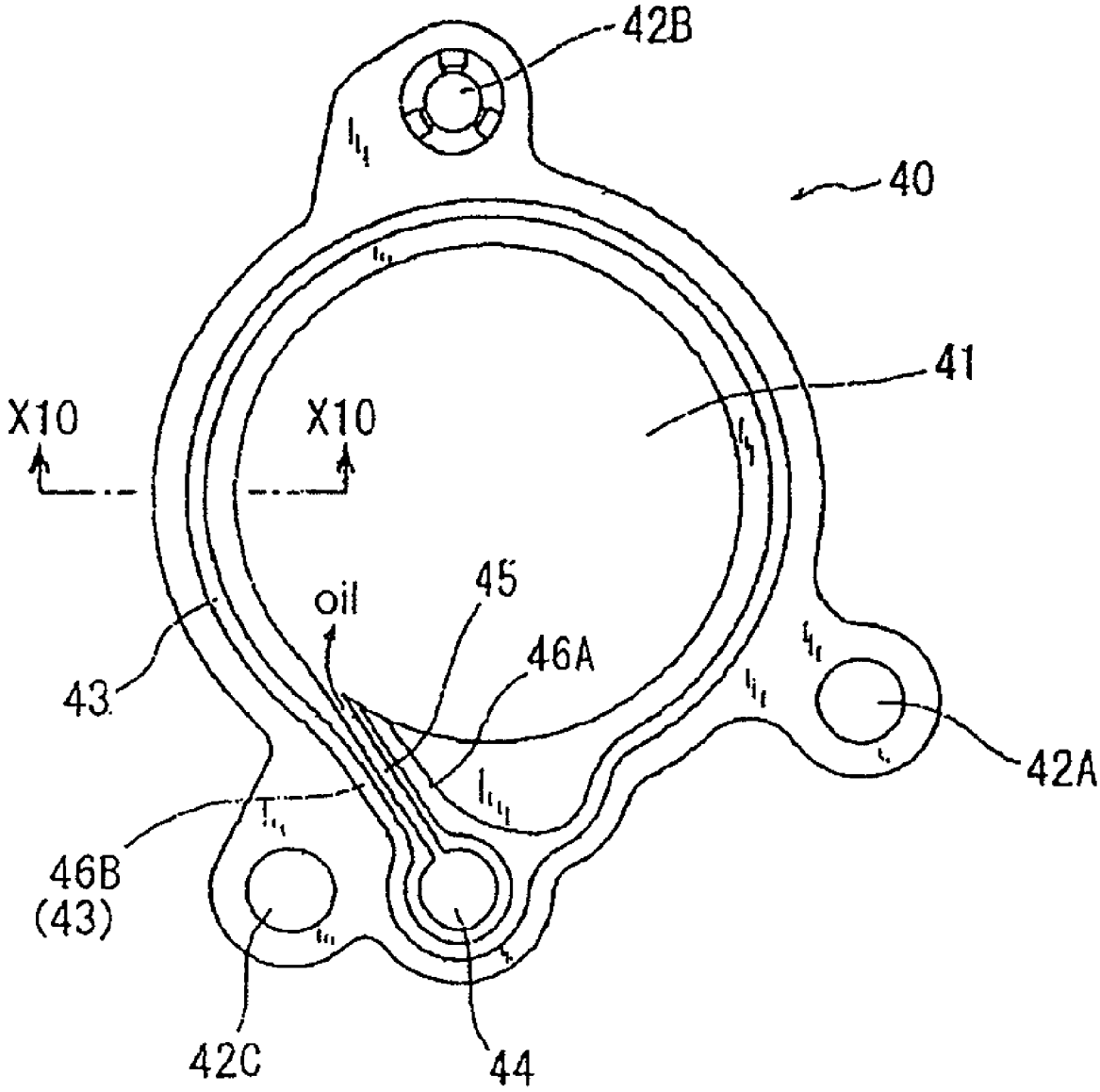
FIG. 9 is a plan view of a metal gasket.
Figure 10:
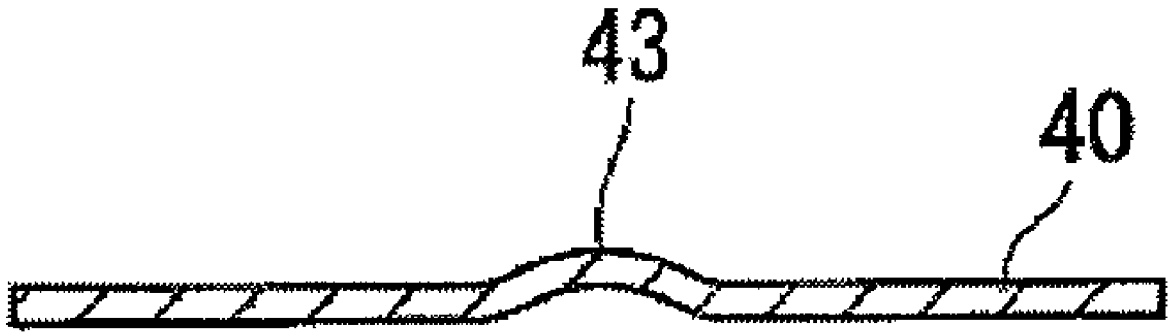
FIG. 10 is a cross-sectional view taken along a line X10-X10 of FIG. 9.

As shown in FIGS. 8 and 9 in detail, the metal gasket 40 is formed in an annular shape, and has a large center opening 41 formed in its central part, into which the cam part 11 can be inserted. Insertion holes 42A, 42B, and 42C into which the attachment bolts 22A-22C are inserted, respectively, are formed in an outer perimeter edge part of the metal gasket 40. A circular (in plan view in FIG. 9) sealing bead part 43 for sealing is formed in the metal gasket 40 so as to conform to the outer perimeter edge part. A cross section of the metal gasket 40 and circular sealing bead part 43 is illustrated in FIG. 10.

In order to supply lubricant to the cam part storage space 23, a lubricant supply hole 32 (refer to FIG. 8) is formed in the attaching part 30, and the lubricant supply hole 32 communicates with a lubricant supply passage 12 (refer to FIG. 7) inside the cylinder head 1. A lubricant return hole 33 is formed in the attaching part 30 at a position higher than the lubricant supply hole 32 (refer to FIG. 8). The lubricant return hole 33 communicates with a lubricant return passage (not illustrated) inside the cylinder head 1.

A hole part 44 continuing to the lubricant supply hole 32 formed in the attaching part 30 is formed in the metal gasket 40. A slit 45 is formed in the metal gasket 40 where one end of the slit 45 communicates with the hole part 44 and the other end communicates with the cam part storage space 23. Because the metal gasket 40 itself is thin, an amount of lubricant supplied to the cam part storage space 23 from the hole part 44 can be set to a small suitable quantity only by setting of a width of the slit 45.

The hole part 44 and the slit 45 are located inside the circular sealing bead part 43. Near the slit 45, a pair of left and right linear bead parts 46A and 46B are formed along the slit 45 (the bead shape is similar to that of the circular sealing bead part 43). In this embodiment, a part of the circular sealing bead part 43 is formed so as to be along the slit 45 and near the outside of the slit 45. The portion along the slit 45 constitutes one linear bead part 46B (a part of the circular sealing bead part 43 also constitutes the linear bead part 46B).

In the above configuration, the lubricant from the lubricant supply passage 12 formed inside the cylinder head 1 is stably supplied to the cam part storage space 23 only by a small quantity via the lubricant supply hole 32 of the attaching part 30, the hole part 44 formed in the metal gasket 40, and then, the slit 45. Surplus lubricant in the cam part storage space 23 is returned to a lubricant return passage (not illustrated) inside the cylinder head 1 via the lubricant return hole 33 formed in the attaching part 30.

The cam part storage space 23 is effectively sealed by the circular sealing bead part 43. Further, by the linear bead parts 46A and 46B, a little quantity of lubricant corresponding to the set width of the slit 45 is stably supplied. Here, the communicating position of the slit 45 with the cam part storage space 23 is preferably set to a height position which is substantially the same as or higher than the lubricant return hole 33. When the engine is stopped, lubricant inside the cam part storage space 23 may flow back via the slit 45 and, thus the lubricant quantity inside the cam part storage space 23 may run short. However, by the above setting of the height position, substantially at least a quantity of the lubricant corresponding to the height position of the lubricant return hole 33 can be accumulated in the cam part storage space 23 (lubrication of the cam part 11 when the engine is restarted is effectively attained).

As described above, the invention is not limited to the embodiment described above, and the invention may be properly modified without departing from the scope of the invention, and, for example, it may also include the following cases. As the auxiliary machine, any other arbitrary type of auxiliary machine may be chosen without limiting to the fuel pump 3. Alternatively, another auxiliary machine (for example, a vacuum pump) may be provided outside of the fuel pump 3. In this case, for example, a lubricant passage that communicates the hole part 44 of the metal gasket 40 with the housing of the second auxiliary machine formed in the auxiliary machine housing member 20 of the fuel pump 3 to supply lubricant into the housing of the second auxiliary machine. If the circular sealing bead part 43 is not formed near and along the slit 45, one linear bead part 46B may be formed separately from the circular sealing bead part 43. Of course, the purpose of the invention implicitly includes providing what is expressed as substantially desirable or advantageous without limiting to what is expressly described above.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A lubricant supply device for an auxiliary machine of an engine, comprising:

a cam formed at one end of a cam shaft rotatably supported by a cylinder head, the cam extending outside of the cylinder head;

a housing, for storing the auxiliary machine, attached to an attaching surface formed at an end of the cylinder head, the housing holding a driven member driven by the cam and having a cam storage space for storing the cam;

a lubricant hole formed on the attaching surface through which lubricant is supplied from a lubricant passage formed in the cylinder head to the cam storage space; and a metal gasket positioned between the attaching surface and the housing, the metal gasket sealing the cam storage space and outside, wherein the metal gasket has a hole for communicating with the lubricant hole, a slit communicating between the hole and the cam storage space, a circular sealing bead which surrounds the hole, and a pair of linear sealing beads connected to the circular sealing bead and respectively extending along the slit at both sides of the slit.

2. The lubricant supply device for the auxiliary machine of the engine according to claim 1 wherein, the slit is formed inside of the circular sealing bead, and a part of the circular sealing bead is provided close to the slit and outside of the slit so as also to serve as one of the linear sealing beads.

3. The lubricant supply device for the auxiliary machine of the engine according to claim 1 wherein, the auxiliary machine is a high-pressure fuel pump which has a plunger as the driven member and which generates high-pressure fuel to be supplied to a fuel injector of the engine, and a lubricant return hole is formed on the attaching surface to be facing and open into the cam storage space, wherein the lubricant return hole returns surplus lubricant gathered in the cam storage space into the cylinder head.

4. The lubricant supply device for the auxiliary machine of the engine according to claim 3 wherein, a connecting point between the slit and the cam storage space is positioned approximately as high as or higher than the lubricant return hole.

5. A lubricant supply device for an auxiliary machine of an engine, wherein the auxiliary machine is a high-pressure fuel pump which has a plunger as a driven member and generating high-pressure fuel to be supplied to a fuel injector of the engine, comprising:

a cam formed at one end of a cam shaft rotatably supported by a cylinder head, the cam extending outside of the cylinder head;

a housing, for storing the auxiliary machine, attached to an attaching surface formed at an end of the cylinder head, the housing holding a driven member driven by the cam and having a cam storage space for storing the cam;

a lubricant hole formed on the attaching surface through which lubricant is supplied from a lubricant passage formed in the cylinder head to the cam storage space; and a metal gasket positioned between the attaching surface and the housing, the metal gasket sealing the cam storage space and outside, wherein the metal gasket has a hole for communicating with the lubricant hole, a slit communicating between the hole and the cam storage space, a circular sealing bead which surrounds the hole, and a pair of linear sealing beads connected to the circular sealing bead and respectively extending along the slit at both sides of the slit.

6. The lubricant supply device for the auxiliary machine of the engine according to claim 5 wherein, the slit is formed inside of the circular sealing bead, and a part of the circular sealing bead is provided close to the slit and outside of the slit so as also to serve as one of the linear sealing beads.

7. A lubricant supply device for an auxiliary machine of an engine, comprising:

a cam formed at one end of a cam shaft rotatably supported by a cylinder head, the cam extending outside of the cylinder head;

a housing, for storing the auxiliary machine, attached to an attaching surface formed at an end of the cylinder head, the housing holding a driven member driven by the cam, and having a cam storage space for storing the cam;

a lubricant hole formed on the attaching surface through which lubricant is supplied from a lubricant passage formed in the cylinder head to the cam storage space;

a metal gasket positioned between the attaching surface and the housing, the metal gasket sealing the cam storage space and outside, and a lubricant return hole formed on the attaching surface to be facing and open into the cam storage space, the lubricant return hole returning surplus lubricant gathered in the cam storage space into the cylinder head, wherein the metal gasket has a hole for communicating with the lubricant hole, a slit communicating between the hole and the cam storage space, a circular sealing bead which surrounds the hole, and a pair of linear sealing beads connected to the circular sealing bead and respectively extending along the slit at both sides of the slit.

8. The lubricant supply device for the auxiliary machine of the engine according to claim 7 wherein, a connecting point between the slit and the cam storage space is positioned approximately as high as or higher than the lubricant return hole.

* * * * *